US005603073A

United States Patent [19]

Bose

[11] Patent Number: 5,603,073

[45] Date of Patent: Feb. 11, 1997

[54] HEAVY ALLOY BASED ON TUNGSTEN-NICKEL-MANGANESE

[75] Inventor: Animesh Bose, Petaluma, Calif.

[73] Assignee: Southwest Research Institute, San Antonio, Tex.

[21] Appl. No.: 938,821

[22] Filed: Sep. 1, 1992

Related U.S. Application Data

[62] Division of Ser. No. 686,130, Apr. 16, 1991.

[51] Int. Cl.[6] ..... B22F 3/16

[52] U.S. Cl. ..... 419/57; 419/53; 419/54; 419/55; 419/58; 419/42; 419/47

[58] Field of Search ..... 75/623; 419/42, 419/47, 49, 55, 57, 58, 24, 53, 54; 420/430; 428/569

[56] References Cited

U.S. PATENT DOCUMENTS

| | | | |
|---|---|---|---|
| 3,300,285 | 1/1967 | Pugh et al. | 29/182 |
| 3,988,118 | 10/1976 | Grierson et al. | 29/182 |
| 4,698,096 | 10/1987 | Schmidberger et al. | 75/248 |
| 4,749,410 | 6/1988 | Mullendore et al. | 75/248 |
| 4,851,042 | 7/1989 | Bose et al. | 75/248 |
| 4,921,665 | 5/1990 | Klar et al. | 419/23 |
| 4,931,252 | 6/1990 | Brunisholz et al. | 419/23 |
| 4,938,799 | 7/1990 | Nicolas | 75/248 |
| 4,960,563 | 10/1990 | Nicolas | 419/23 |

*Primary Examiner*—Charles T. Jordan
*Assistant Examiner*—Anthony R. Chi
*Attorney, Agent, or Firm*—Baker & Botts, L.L.P.

[57] ABSTRACT

A high density, high strength and high compressive strain tungsten heavy alloy consists essentially of tungsten in the amount of approximately 90% by weight, and the rest Mn and Ni in an amount sufficient to cause sintering at between 1100° and 1400° C. The W—Ni—Mn alloy exhibits characteristics of intense shear bands (which could indicate failure by adiabatic shear during high strain-rate dynamic testing) thus making it an attractive material for kinetic energy penetrators. Moreover, the alloy provides an inexpensive high density material which can be produced in furnaces for conventional ferrous powder metal part manufacturing and other conventional non-ferrous powder metal part manufacturing by lowering the sintering temperature by 200° to 300° C.

18 Claims, 7 Drawing Sheets

HEAVY ALLOY BASED ON TUNGSTEN-NICKEL-MANGANESE

RELATED APPLICATIONS

This application is a division of application Ser. No. 07/686,130, filed Apr. 16, 1991 and entitled "TERNARY HEAVY ALLOY BASED ON TUNGSTEN-NICKEL-MANGANESE".

TECHNICAL FIELD OF THE INVENTION

The present invention relates to heavy tungsten-nickel-manganese alloys having a high density, but a relatively low sintering temperature and the potential for adiabatic shear and a process for the production of the alloys.

BACKGROUND OF THE INVENTION

High density is one of the key desired attributes penetrators, aircraft and helicopter balance blades, and radiation shields. Kinetic energy penetrators are used, for example, in military applications for piercing and penetrating heavy armor found on tanks and armored personnel carriers. In kinetic energy penetrators, generally, the higher the density of the material, the greater the desired penetration. For aircraft and helicopter balance blades, the aim is to concentrate the maximum possible weight in the smallest possible space. And for radiation shields, higher density results in higher absorption of X-rays and gamma radiation. Thus, economical high density materials in bulk shapes, have many important applications. However, most of the high density materials (with densities greater than 16 or 17 g/cc) like gold, rhenium, tungsten, osmium, iridium, uranium, etc., are either very expensive or extremely difficult to process.

For example, there are only two known types of economically viable and operationally successful kinetic energy penetrating materials: depleted uranium (DU) and tungsten heavy alloys. Both types of materials possess the high density, strength and ductility combination which is required for ballistic penetration. However, existing forms of these alloys suffer from significant limitations. At present, DU is known to be a more effective penetrator material than an equivalent-density tungsten heavy alloy. Mounting political pressure and increasing environmental issues have created conditions where DU penetrators, in spite of their superior effective penetration characteristics, are being discarded in favor of tungsten heavy alloys.

The superior performance of DU is attributable to its ability to fail through the formation of adiabatic shear. This results in constant "self-sharpening" during penetration of the DU penetrator that prevents a "mushrooming" effect that can otherwise occur. Mushrooming during ballistic penetration produces a resisting pressure on the projectile over a large area that causes increasing deceleration force and detrimentally affects penetration efficiency. State-of-the-art tungsten heavy alloys based on W—Ni—Fe do not self-sharpen, but mushroom instead and thereby lose penetration efficiency. If a tungsten heavy alloy could be produced which failed during penetration in a localized adiabatic shear, then the penetration performance would be similar to that of the DU kinetic energy penetrators.

Yet another limitation associated with tungsten heavy alloys is inherent in the tungsten itself. Tungsten which has a density of 19.3 g/cc is brittle and requires extremely high processing temperatures (around 2,000° C.) to obtain full density. Tungsten heavy alloys that have been developed avoid this problem, by essentially "gluing" in a lower density ductile alloy matrix. The matrix alloy consists of nickel alloyed with either iron, copper, cobalt, and some amount of tungsten which is taken into solution. This ductile matrix serves a two-fold purpose. First, it imparts ductility to the brittle tungsten, and second, it lowers the process temperature of the tungsten heavy alloy.

The typical liquid-phase sintering temperature for known tungsten heavy alloys varies from 1450° to 1650° C. While this sintering temperature is significantly lower than that of pure tungsten, it is still too high for general powder metallurgical production furnaces. For example, U.S. Pat. No. 4,938,799 to Nicolas filed on Oct. 5, 1988 and entitled "Heavy Tungsten-Nickel-Iron Alloys with Very High Mechanical Characteristics and Process for Production of Said Alloys" discloses an alloy with a specific gravity of between 15.6 and 18. These alloys include a tungsten α-phase in the shape of butterfly wings with dislocation cells of dimensions between 0.1 and 1 μm and a Ni—Fe bonding gamma-phase having a mean free path of less than 15 μm and a Ni/Fe ratio greater than or equal 2.0. The alloy of that invention requires a sintering temperature of between 1490° and 1650° C. for from 2 to 5 hours and further requires strengthening by way of special thermal chemical treatments. These temperatures and processes are usual beyond the capability of general powder metallurgical production furnaces and thus may add significantly to the production costs of the alloy or at least limit the accessibility of the alloy for many applications.

Thus there is a need for an inexpensive high-density alloy that can be used for a variety of purposes.

There is a need for an inexpensive high-density alloy that does not suffer from the environmental issues relating to DU, but can be used as successfully for kinetic energy penetrators.

There is a further need for a tungsten heavy alloy that does not suffer from the known mushrooming effects typical of existing tungsten heavy alloys. In particular, there is a need for a tungsten heavy alloy that during ballistic penetration fails through the formation of adiabatic shear.

Further, there is a need for a tungsten heavy alloy that can be produced by conventional ferrous powder metal part manufacturers and other conventional non-ferrous powder metal part manufacturers without the need for reconfiguring their furnaces.

SUMMARY OF THE INVENTION

Accordingly, the present invention provides a heavy alloy based on tungsten-nickel-manganese and a process for producing the alloy which overcomes the problems and satisfies the needs previously considered.

According to one aspect of the invention there is provided a tungsten heavy alloy having high density, that consists essentially of tungsten in the amount of at least 80% by weight, and the rest a combination of manganese and nickel in an amount sufficient to lower the alloy's sintering temperature to between 1100° and 1400° C. The preferred embodiment consists essentially of the amount of approximately 90% by weight of W, the amount of approximately 6% by weight of Mn, and the rest of approximately 4% by weight of Ni with a sintering temperature of between 1200° and 1300° C. and a sintering time of approximately 60 minutes.

The process for producing the tungsten heavy alloy essentially comprises the steps of mixing a composition of elemental powders including W in the amount of at least 80% by weight, and the rest a combination of manganese and nickel in an amount sufficient to lower the alloy's sintering temperature to between 1100° and 1400° C. In the preferred embodiment, the alloy comprises approximately 90% by weight of W, the amount of 6% by weight of Mn, and the rest of approximately 4% by weight of Ni with a sintering temperature of between 1200° and 1300° C. and a sintering time of approximately 60 minutes. The process further includes compacting the mixed composition into the form of compacted items such as pellets or rods and then sintering the compact items at separate sintering temperature of between 1100° and 1400° C.

A technical advantage of the tungsten-based heavy alloy of the present invention is that it is relatively inexpensive and easy to process. As a result, the alloy of the present invention may be produced by ferrous powder metal part manufacturers and other conventional non-ferrous powder metal part manufacturers who have furnace temperature capabilities of 1200° to 1300° C. The lowered sintering temperature of the alloy of the present invention provides a tremendous impetus for the general powder metal part manufacturers to sinter this alloy for high density applications, because they may do so without having to change their existing furnace configurations.

Another technical advantage of the present invention is that in high strain-rate testing, the heavy alloy is shown to undergo adiabatic shearing. The alloy of the present invention concentrates into narrow adiabatic shear bands. This is most likely because its rate of material hardening is lower than the thermal softening caused by the conversion of mechanical work to heat that occurs during high strain rate testing. As a result, the tungsten heavy alloy of the present invention has the potential for properties comparable to DU, without the political issues surrounding the use of DU.

DESCRIPTION OF THE DRAWINGS

The invention and its modes of use and advantages are best understood by reference to the following description of illustrative embodiments when read in conjunction with the accompanying drawings, wherein.

FIGS. *7a–7d* show low power magnifications of microstructures of alloys according to the present invention sintered at temperatures of 1100°, 1200°, 1300°, and 1500° C., respectively.

Figure 9:
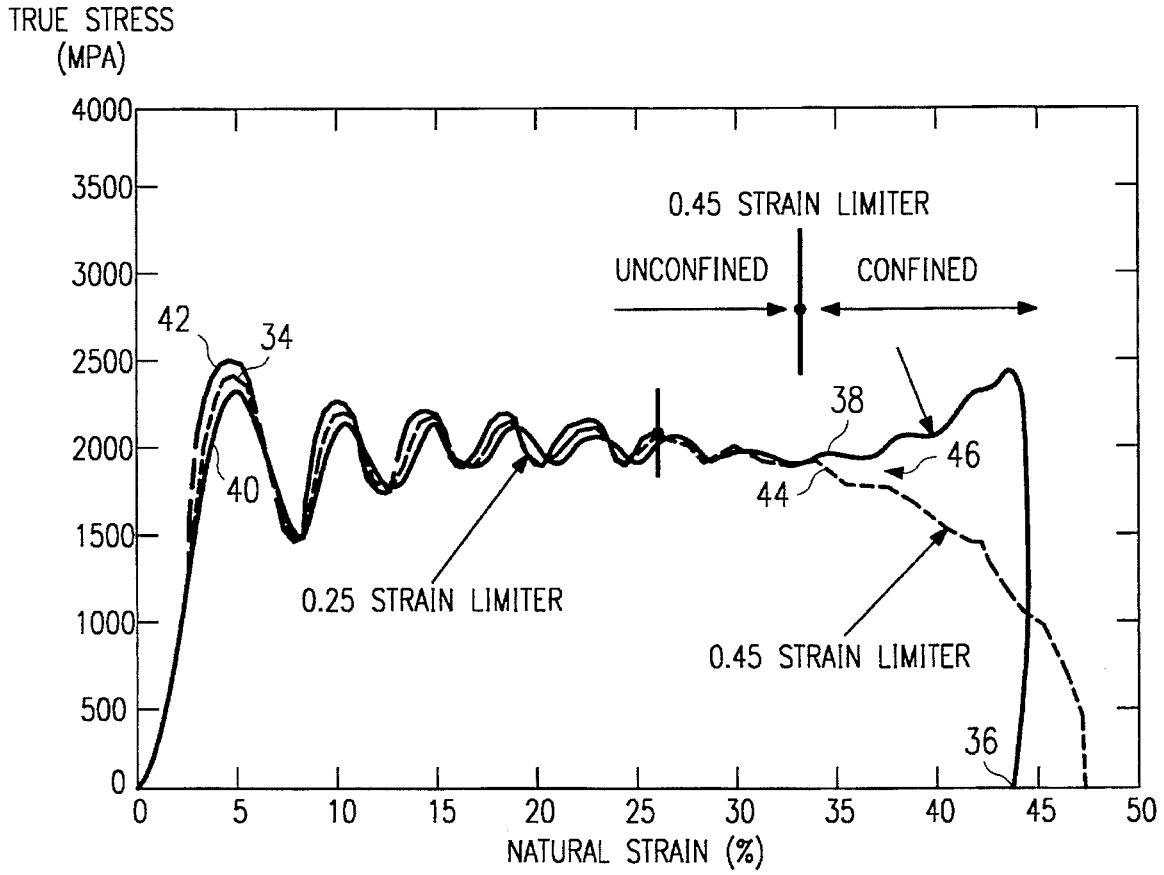
Figure 7A:
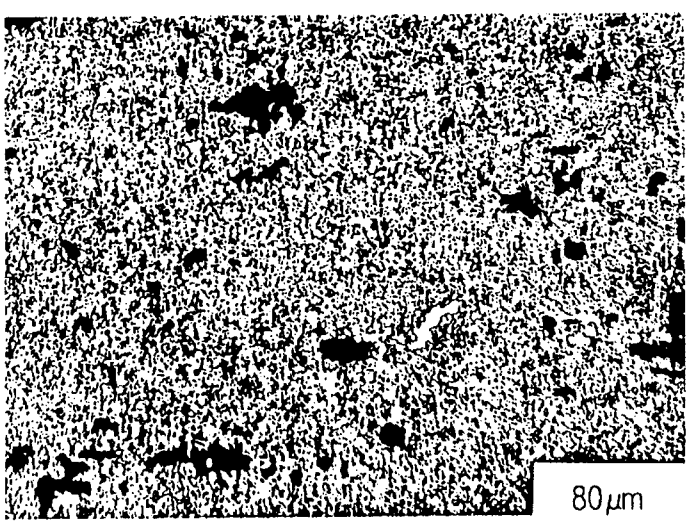
Figure 7B:
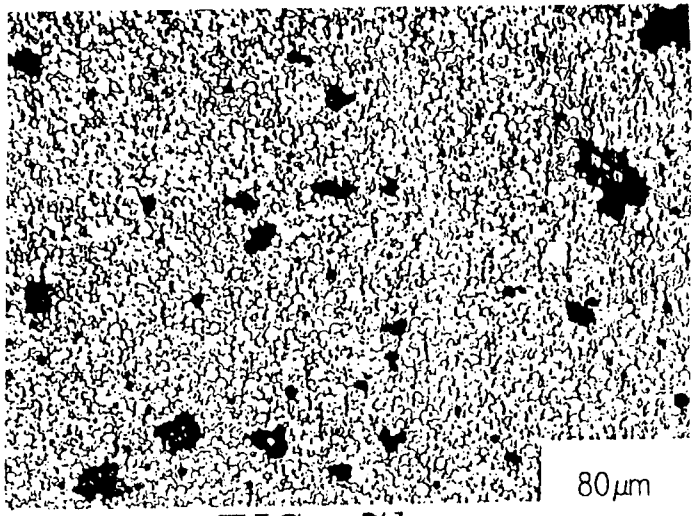
Figure 7C:
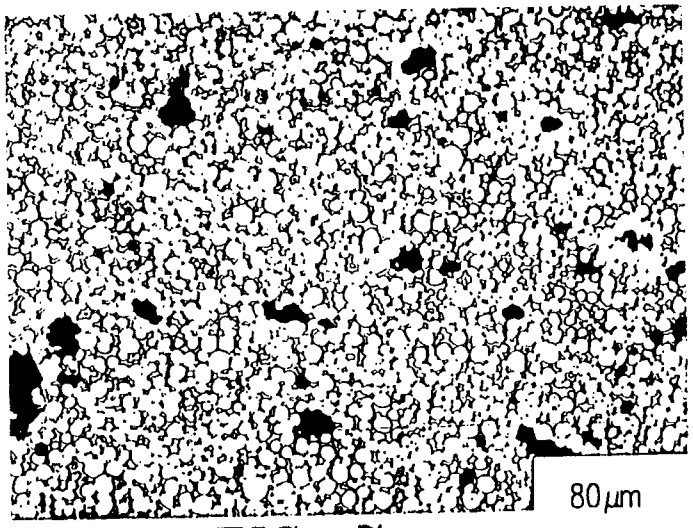
Figure 7D:
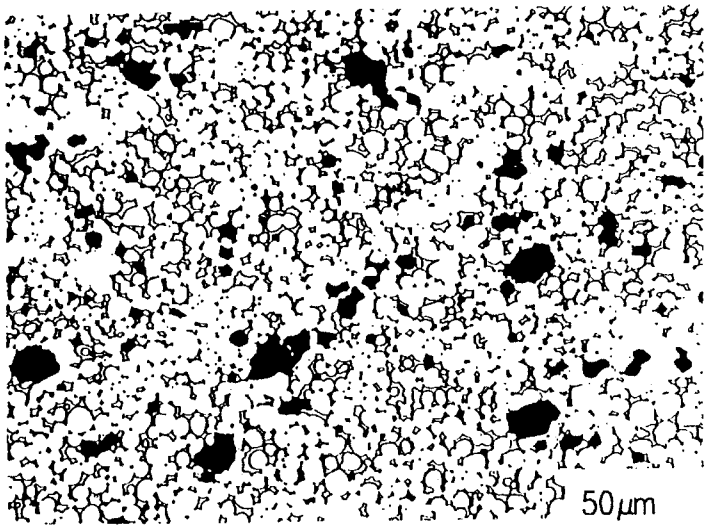
Figure 10:
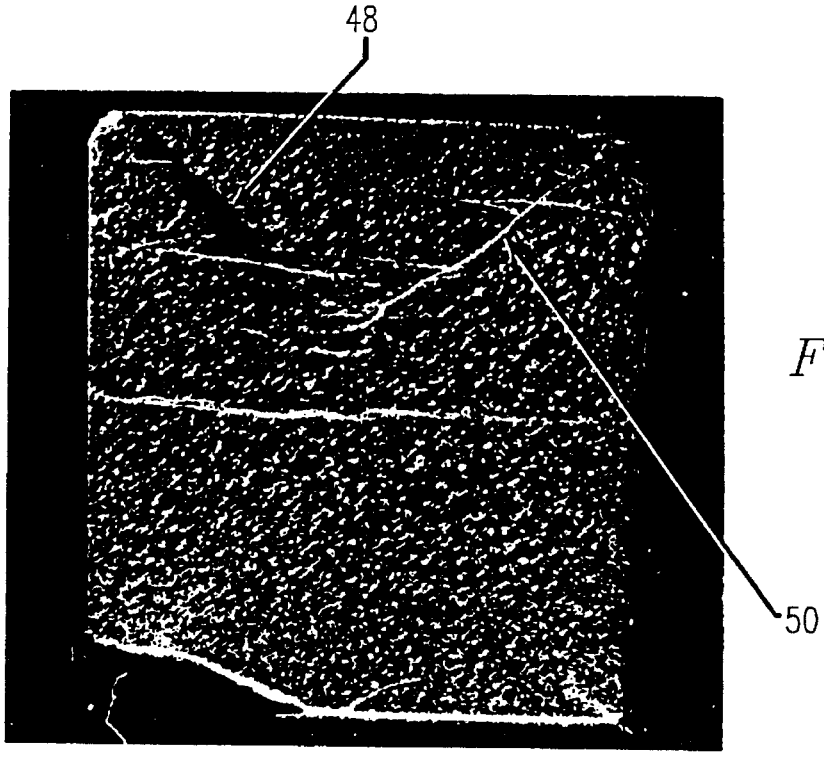
Figure 11:
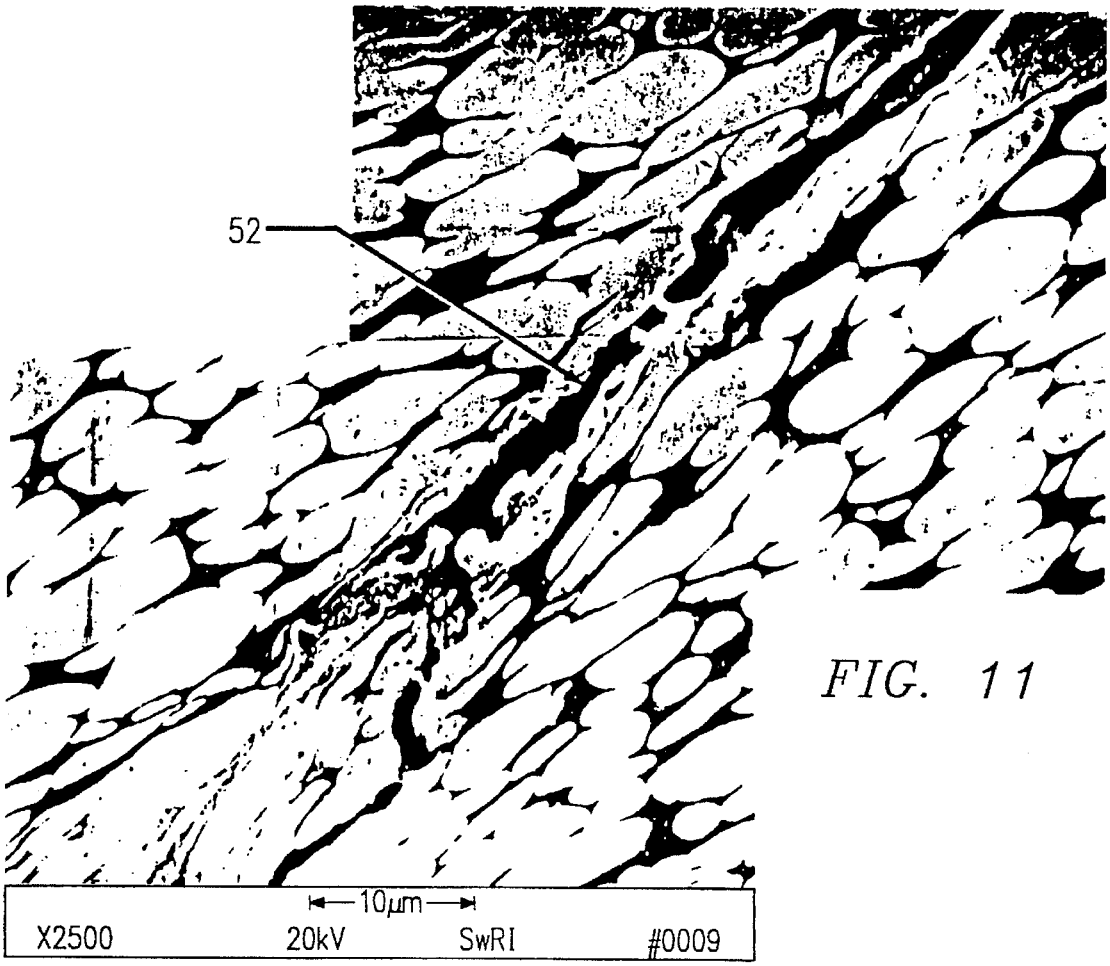

FIGS. *8a–8d* are high magnification pictures of the sintered alloys that show the effect of grain size on the sintering temperatures for the respective temperatures of 1100°, 1200°, 1300°, and 1500° C.;

FIG. 9 is a true stress (MPa) v. natural strain (%) plot showing the dynamic stress-strain response of the W—Ni—Mn alloy of the present invention;

FIG. 10 is a macrophotograph of a polished section of a dynamically tested specimen of the W—Ni—Mn alloy of the present invention showing intense 45° shear bands; and FIG. 11 provides a magnified view of the internal section of the shear band resulting from the dynamic testing described in association with FIG. 10.

DETAILED DESCRIPTION OF THE INVENTION

Recent experiments performed at the U.S. Army Ballistic Research Laboratory provide sufficient evidence that superior performance in kinetic energy penetrator materials is attributal to the formation of adiabatic shear during ballistic penetration. This type of failure causes constant "self-sharpening" as the penetrator moves through the material it penetrates. When self-sharpening does not occur, the penetrator undergoes a mushrooming effect. The mushrooming has a detrimental effect on the penetration efficiency, because a resisting pressure of the projectile occurs over a larger area to cause an increasingly large deceleration force.

There are two known types of materials that are useful for inexpensive high-density kinetic energy penetrators: depleted uranium (DU) and tungsten heavy alloy based on W—Ni—Fe. DU successfully exhibits the self-sharpening characteristics during ballistic penetration, but is undesirable because of its environmental concerns. Known tungsten heavy alloys based on W—Ni—Fe, however, do not self-sharpen. As a result, these alloys produce lower penetration efficiencies than does DU. To overcome this problem, the present invention provides a tungsten heavy alloy in which localized adiabatic shear failure is enhanced to induce self-sharpening, and thereby increasing the likelihood of superior ballistic penetration efficiency.

To produce a tungsten heavy alloy whose matrix will be more prone to adiabatic shear, it is necessary to understand the elements which tend to favor adiabatic shear. Very simply, if the rate of hardening of the material undergoing plastic deformation is lower than the thermal softening caused by the conversion of mechanical work to heat, deformation may concentrate into narrow adiabatic shear bands.

The factors that tend to promote adiabatic shear are low thermal conductivity, specific heat, density, and strain hardening rate, and high shear yield stress and thermal softening rate. Elemental constituents of certain known tungsten heavy alloys and of the W—Ni—Fe alloy of the present invention are shown in Table I. Also included are the properties of uranium from which DU is derived.

TABLE 1

SOME IMPORTANT PHYSICAL PROPERTIES OF ELEMENTS RELEVANT TO PENETRATOR APPLICATIONS

| ELEMENT | MELTING POINT °C. | DENSITY g/cc | THERMAL CONDUCTIVITY 0–100° C. $W.m^{-1}K^{-1}$ | MEAN SPECIFIC HEAT 0–100° C. $J.kg^{-1}K^{-1}$ |
|---|---|---|---|---|
| Uranium | 1132 | 19.05 (α) | 28 | 117 |
| Tungsten | 3387 | 19.3 | 174 | 138 |
| Nickel | 1455 | 8.9 | 88.5 | 452 |
| Iron | 1536 | 7.87 | 78.2 | 456 |
| Hafnium | 2227 | 13.1 | 22.9 | 147 |
| Manganese | 1244 | 7.4 | 7.8 | 486 |

As Table I shows, Mn has an extremely low thermal conductivity which is close to a third of uranium and approximately an order of magnitude lower than iron. The Mn mean specific heat value is comparable to iron, but around four times higher than uranium. Mn also has a lower melting point than iron. Therefore, relative to iron, the rate of hardening of an alloy containing Mn may be expected to be lower than the thermal softening caused by the conversion of mechanical work to heat. This will make a tungsten heavy alloy containing Mn prone to failure by adiabatic shear.

Figure 1:
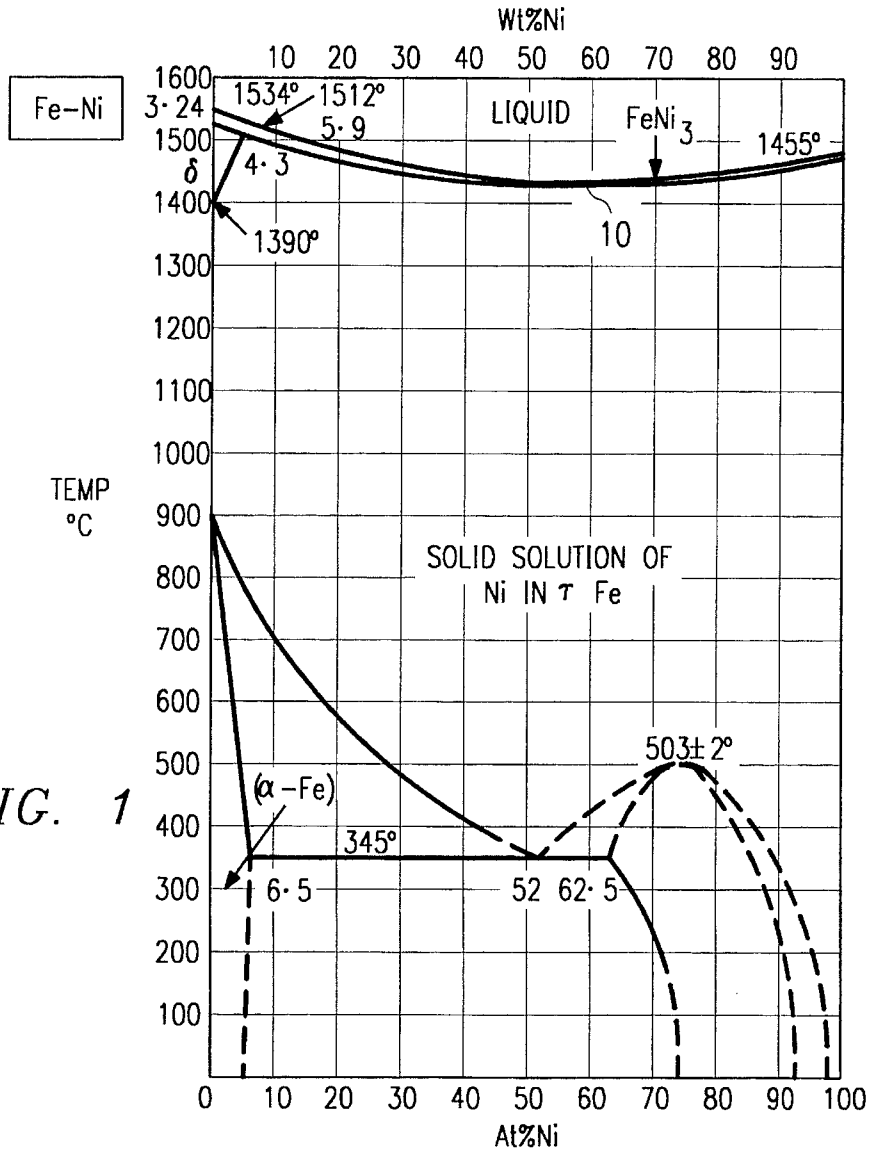
FIG. 1 is the well-known binary Ni—Fe phase diagram.

Another attraction of the W—Ni—Mn alloy of the present invention is its potential to be sintered at temperatures of 1200° to 1300° C. This temperature is approximately 200° to 300° below the sintering temperature of known heavy alloys. For example, cobalt, copper and iron have generally been used as the other additive along with nickel in tungsten heavy alloys with iron being the preferred material. The binary Ni—Fe phase diagram near the 7Ni:3Fe composition forms a liquid at 1435° C. as FIG. 1 shows at 10. (Smithells Metals Reference Book, at 11–250 (6th Ed. 1983).) Even considering the W—Ni—Fe alloy system, the first liquid can be observed to form at temperatures above 1400° C.

Figure 2:
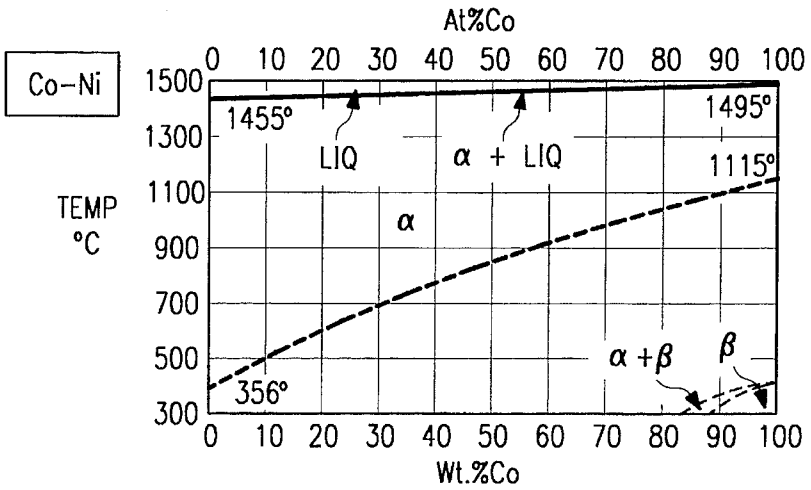
FIG. 2 is the well-known binary Ni—Co phase diagram.

FIG. 2 shows the well-known Ni—Co binary phase diagram (Smithells Metals Reference Book, at 11–192). The Ni—Co phase diagram illustrates that liquid formation temperature remains above 1400° C. for all combinations of these constituent elements. As a result, the sintering temperature of a tungsten heavy alloy comprising these elements would yet be beyond the reach of conventional powder metal part manufacturer's furnaces.

Figure 3:
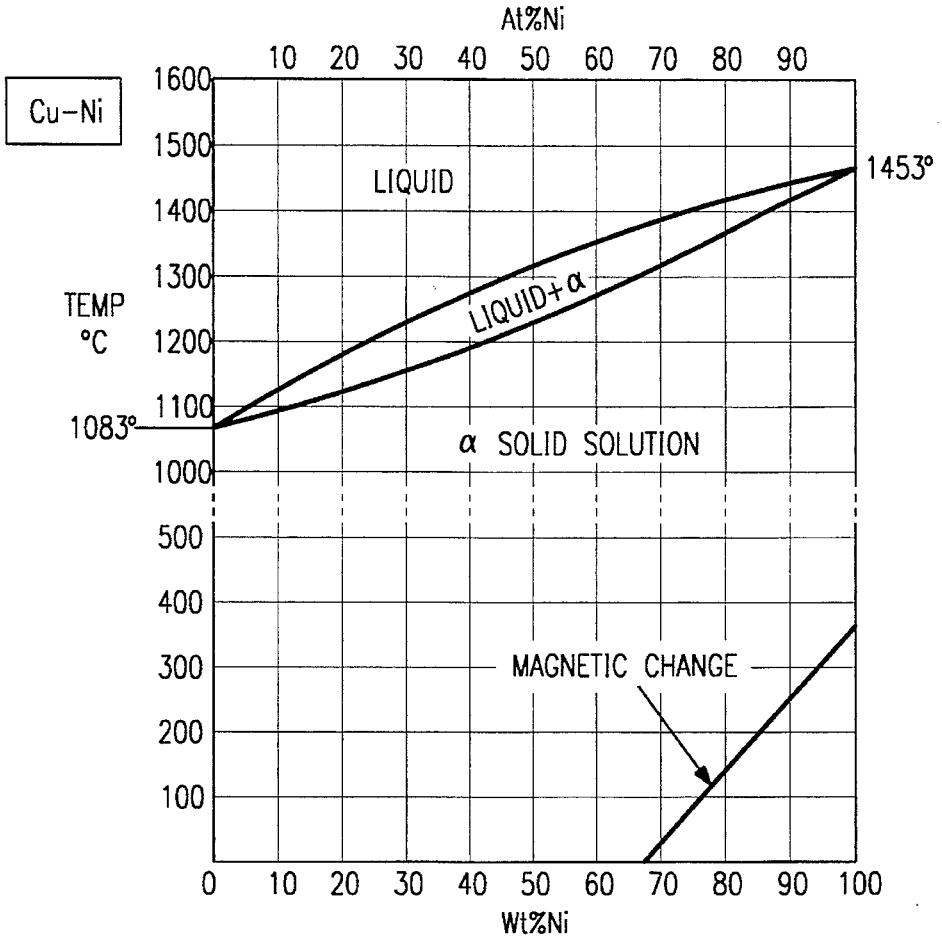
FIG. 3 is the well known binary Cu—Ni phase diagram.

FIG. 3 illustrates the Ni—Cu phase diagram which exhibits an isomorphous system where the liquid formation temperature is strongly dependant on the alloy composition. (Smithells Metals Reference Book, at 11–224) FIG. 3 shows that the first liquid could form at a temperature at above 1250° C. for a mixture of equivalent weight fraction of nickel and copper. Thus, whether a Ni alloy forms a liquid within the range of the known powder metal manufacturing furnace temperatures depends on the metals with which the nickel combines.

Figure 4:
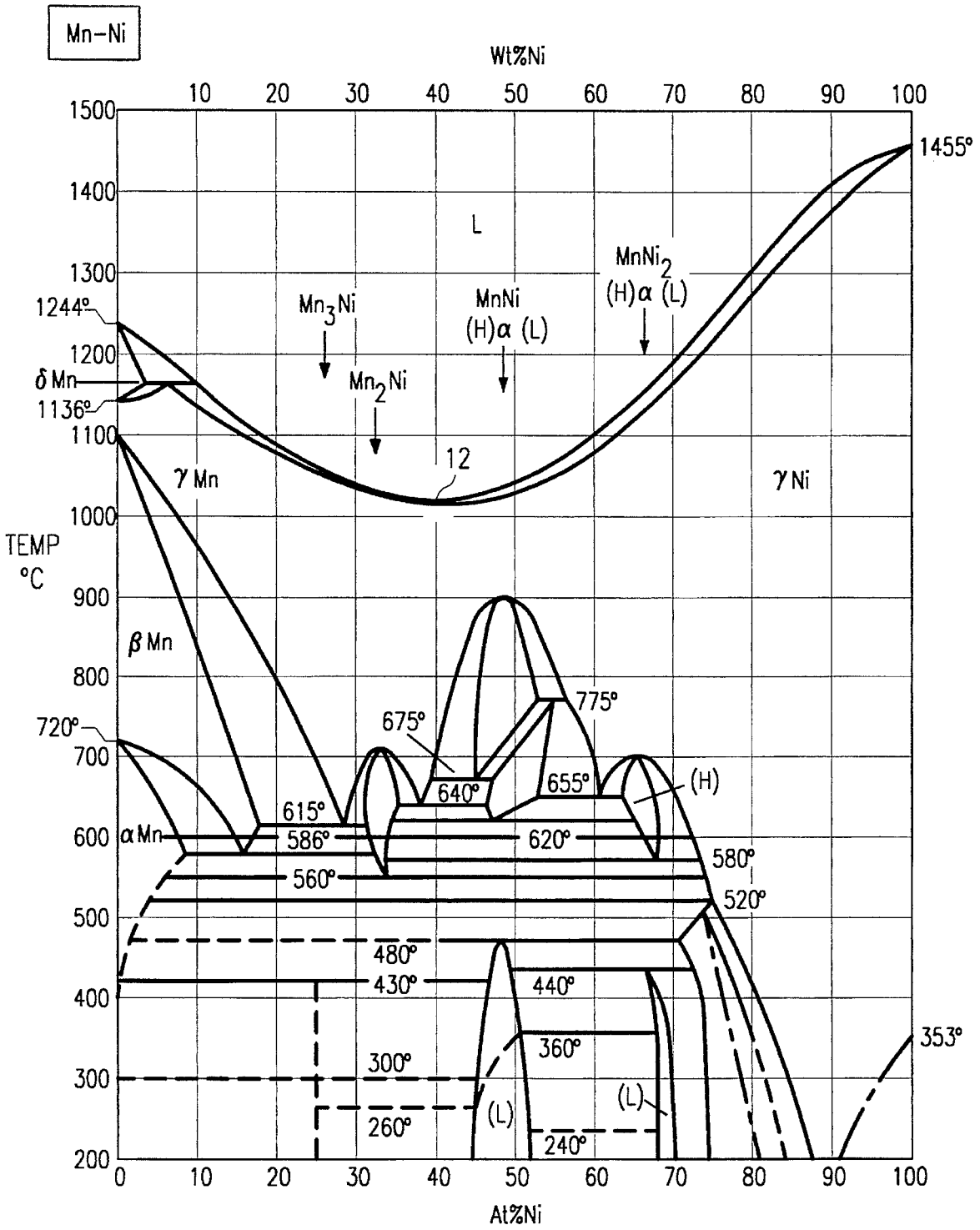
FIG. 4 is a binary Mn—Ni phase diagram.

FIG. 4, however, shows at 12 that a 60 Mn-40 Ni alloy forms a liquid at 1025° C. (Smithells Metals Reference Book, at 11–342) This significantly contrasts to the nickel based binary systems of FIGS. 1–3. Even if Mn does not have any solubility for tungsten, the presence of Ni in the alloy aids in the process of densification. Thus, theoretically, the W—Ni—Mn alloy provides an exciting alternative alloy system, which could be processed at significantly lower temperatures compared to the W—Ni—Fe heavy alloy. The W—Ni—Mn alloy of the present invention may be sintered at temperatures of 1200° to 1300° C. These temperatures are between 200° and 300° C. below the sintering temperature of known tungsten heavy alloys. Thus, the 1200° to 1300° C. sintering temperature of the alloy of the present invention provides the general powder metal manufacturers the ability to enter into tungsten heavy alloy production without major changes in their furnaces. This would be enough reason for numerous manufacturers to produce this new W—Ni—Mn-based heavy alloy.

Tests carried out on this alloy at high strain rates and under moderate confined pressure indicate that the alloy promotes shear banding at a strain of 0.45. Thus, the W—Ni—Mn alloy of the present invention has the potential for becoming an excellent material for kinetic energy penetrators. The W—Mn—Ni alloy of the present invention may also be used for various non-defense related applications, such as vibration dampeners, counter-balances, heavy duty electrical contact materials, etc. A large number of applications rely on stationary parts which do not require any significant load bearing capability. Because the alloy of the present invention may be sintered to high densities at low temperatures some of these non-critical parts may be easily produced from this material without the requirement of special high temperature furnaces.

To more particularly illustrate the present invention, processing and properties of an exemplary 90 W-6Mn-4Ni wt % alloy are herein described. Names of the vendors for the elemental powders forming this compound, the powder purity, add the mean particle size of the powder are outlined in Table II.

TABLE II

| POWDER CHARACTERISTICS | | | |
|---|---|---|---|
| Property | W | Mn | Ni |
| Vendor | GTE | AESAR | INCO |
| Designation | M35 | — | 123 |
| Purity, pct | 99.98 | 99.3 | 9.99 |
| Mean Size | 2.6 μm | 3.3 μm | −325 mesh |

Mixing of the elemental powders is carried out in a tubular mixer for 60 minutes. Differential thermal analysis (DTA) was carried out on the mixed powders to determine the temperature at which the first liquid formed. Small amounts of pre-weighed powder obtained from the powder mixture was compacted to 12-millimeter diameter pellets of double action die at 70 MPa compacting pressure.

Figure 5:
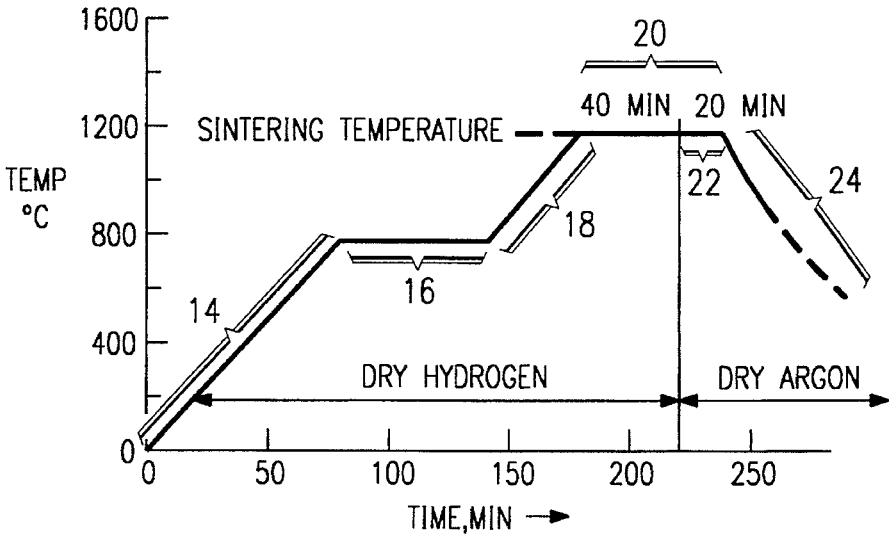
FIG. 5 is a time vs. temperature plot of the sintering cycle for sintering the W—Ni—Mn heavy alloy of the present invention.

FIG. 5 shows the preferred sintering cycle for the above described embodiment of the present invention. This cycle was not only used for 12 millimeter diameter pellets, but also for dogbone tensile specimens and cold isostatically pressed rods described below.

The pellets were sintered at different temperatures using a fixed hold time of 60 minutes at the sintering temperature. The sintering temperatures used were 1100°, 1200°, 1300°, and 1500° C. The sintering schedule consisted of heating the compact to 800° C. at 14 followed by a hold at 16 of 60 minutes at the temperature. This was carried out in dry hydrogen in order to aid the reduction of oxides. The compact is subsequently heated to the desired sintering temperature and held for 60 minutes at 20. The atmosphere is changed from dry hydrogen to dry argon during the last 20 minutes of the sintering cycle at 22. Afterwards, temperature was returned to room temperature by removing the heat energy at 24. The dry argon atmosphere is maintained for the rest of the sintering cycle. Representative samples were mounted and polished, and their microstructures were observed in a scanning electron microscope (SEM).

The mixed elemental powders were also double-sided compacted into dogbone tensile specimens. The dogbone tensile specimens were sintered at the different temperatures outlined above according to the sintering cycle of FIG. 5. The samples were lapped to a 240 grit surface finish. The sintered densities of the samples were measured by the water immersion technique. Hardness of the specimens were measured on the Rockwell C Scale. The samples were then tested at a slow strain rate to failure. Small pieces were removed from the ends of the samples which were not deformed during the tensile test. The samples were mounted and polished and their microstructures were observed in the SEM. Some representative photomicrographs, see FIGS. **8*a*–8*d*** below, were also taken for the characterization and the structure.

Cold isostatically pressed rods were also made from elemental powders pressed at 140 MPa. Again using the FIG. 5 sintering cycle, the pressed rods were sintered at 1300° C. for 60 minutes. A small compression test specimen was machined out from this sintered bar for high strain rate testing. Density of the sintered material was measured on the compression test specimen by the water immersion technique. One end of the sintered rod was cut, mounted, polished, and the microstructure was observed under the SEM. Elemental analysis of different areas of the microstructure was also carried out on the SEM. Grain size, volume fraction of the matrix phase, the elemental analysis of the matrix phase, and the rounded grains were also determined. One high strain rate compression test was conducted with a strain limiter. During testing, the sample bulged, and was confined by the strain limiter. A section of the sample was polished and observed under the microscope.

Figure 6:
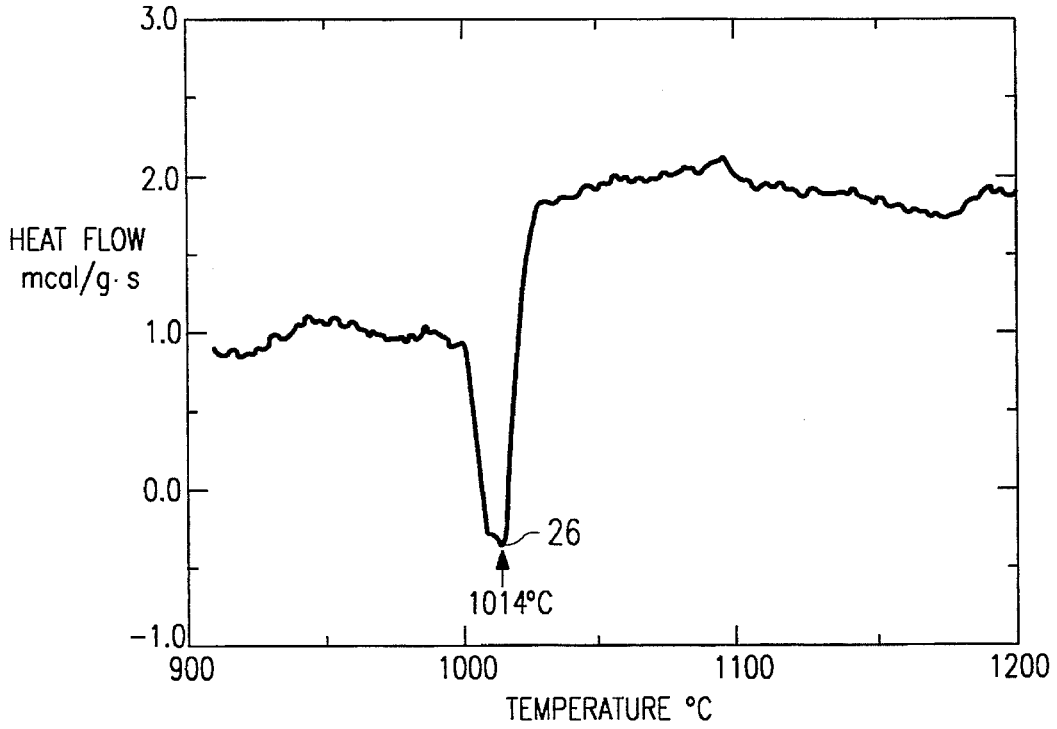
FIG. 6 illustrates the results of differential thermal analysis experiments for determining sintering temperatures for the heavy alloy of the present invention.

Differential thermal analysis (DTA) on the 90W-6Mn-4Ni alloy of the preferred embodiment showed a large endothermic peak of 1014° C. at 26. FIG. 6 shows the DTA results. The temperature of 1014° C. corresponds approximately to the melting point 12 of a 60Mn:40Ni alloy according to the Ni—Mn binary phase diagram of FIG. 4. Thus, liquid formation in the system occurs at a temperature slightly above 1000° C., so it is theoretically possible that this alloy system could be liquid phase-sintered at temperatures around 1050° C. Based on this result, sintering temperatures may be selected for various actual liquid-phase sintering applications.

FIG. 7*a–d*, respectively, show microstructures of alloys at low magnifications that were sintered at temperatures of 1100°, 1200°, 1300°, and 1500° C. The microstructures indicate that alloys have residual pores and oxides. In particular, the pore and oxide content at 1100° and 1200° C. was approximately 4 volume percent (%). This content decreased to 3% at 1300° C. but increased to 6% at 1500° C. At the lower temperatures, the oxide contamination was more dominant, while at 1500° C. the level of porosity is quite high. This is a reflection of the incomplete reduction of MnO that is introduced with the fine manganese powder. The overall density of the samples is seen to increase with sintering temperature while porosity also increases. This probably reflects the higher reduction of MnO at higher temperatures, causing an increase in the density. This occurs because the density of MnO is 5.4 g/cc compared to 7.4 g/cc manganese. However, pores are generated due to the oxide reduction within the closed pore structure.

Figure 8A:
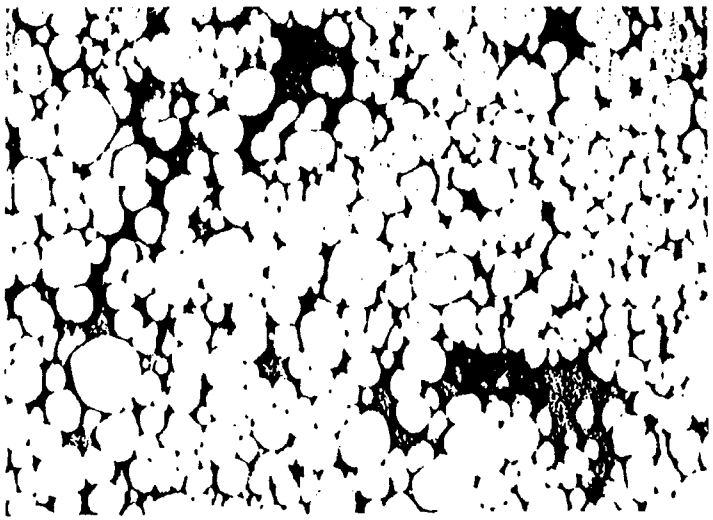
Figure 8B:
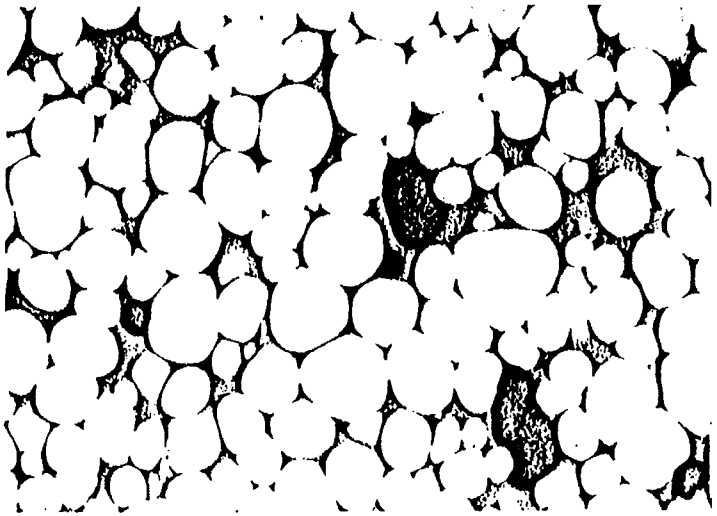
Figure 8C:
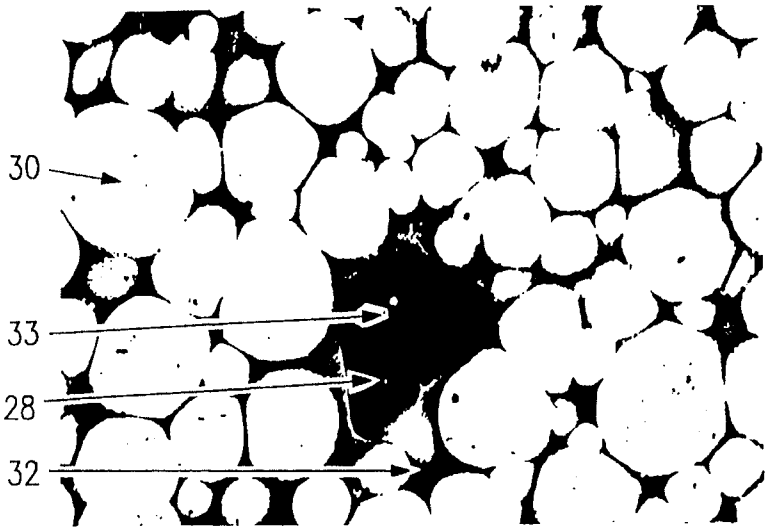
Figure 8D:
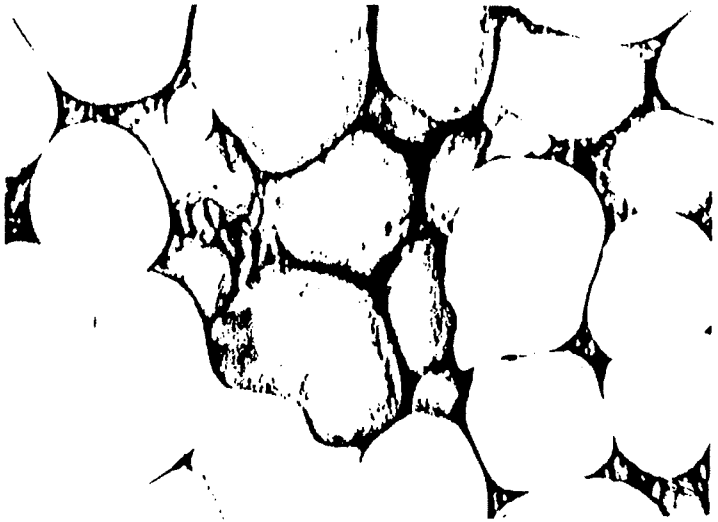

FIGS. 8*a*–8*d* are high magnification pictures of the sintering alloys that illustrate the effect of grain size on the sintering temperature. The grain size of the alloy of the present invention when sintered at 1300° C. was approximately 7 μm. This is considerably finer than the 20 to 50 micron grain size of known tungsten heavy alloys (typically 20–50 pm). In the alloy of the present invention, manganese oxide contaminated the microstructure and generated voids due to oxide reduction and the closed core structure. As a result, the alloy could not be sintered to full density. FIGS. 8*a* and 8*c* show that the pores are in very close proximity of the unreduced oxide. Referring to these figures the dark-grayish area 28 is the MnO, the light grains 30 are merely pure tungsten and the matrix 32 is of the lighter shade of gray. The dark pore 33 is positioned right in the oxide or adjacent to it and is possibly formed due to the reduction of the oxide resulting in the in situ formation of water vapor. The matrix 32 is an alloy of nickel and manganese that has taken into solution a small trace of tungsten. The elemental analysis of the various areas confirms the above discussion.

Hardness and tensile test were carried out on the flat dogbone type of samples sintered at different temperatures. The results of the tensile strength, hardness and density of the alloy sintered at different temperatures were recorded below in Table III.

TABLE III

DENSITY, HARDNESS, AND TENSILE PROPERTIES W-Ni-Nn ALLOY

| Sintering Temperature | Density g/cm$^3$* | Hardness HRc | Tensile strength, MPa |
|---|---|---|---|
| 1100° C. | 15.72 | 35.7 | 258** |
| 1200° C. | 15.95 | 33.2 | — |
| 1300° C. | 16.07 | 33.4 | 396 |
| 1500° C. | 16.13 | 28.1 | 402** |

*theoretical density, 16.9 g/cm$^3$
**broken at grip
Note:
No tensile elongation values have been reported as all the specimens broke in the elastic region.

Each of the specimens broke in the elastic region of the stress-strain curves. Thus, no elongation values of the specimens are reported. This a reflection of the oxide contamination and the residual porosity present in the sintered samples. It is well known that a porosity level greater than 1% is extremely detrimental to properties of heavy alloys (15A R. M. German & K. S. Churn, Metallurgy Transactions, at 747 (1984)). The hardness of the material sintered at 1100° C. was the highest. This is due to the effect of the fine grain size in the alloy. There is, however, not much of difference in the hardness between materials sintered at 1200° and 1300° C., in spite of the finer grain size of material sintered at the lower temperature. The lowest hardness, however, is exhibited by the alloy which is sintered at 1500° C. that alloy having the largest grain size.

The dynamic compression test on the alloy sample was performed at a strain rate of 5,000 $s^{-1}$ with the split Hopkinson pressure bar (SHPB) technique (See Lindholm, 12 J. Mech. Phys. Solids, at 317 (1964)) to determine if the alloy exhibited any adiabatic shear inducted cracking. The dynamic stress-strain response are shown in FIG. 9.

A specimen was loaded to the full capacity of the SHPB technique (0.55 maximum strain with 203 millimeter striker) as shown at line 34. The test set up consists of a compression specimen placed between two long bars. Loading of the specimens was accomplished by propagating a compressive pulse in one elastic bar generated by impacting the 203 mm striker. The pulse was partially transmitted into the second elastic bar and partially reflected by the specimen. From the strain record of the transmitted and reflected pulses in the pressure bar, the stress and strain rate were deduced. By integrating the strain rate with respect to time, the strain versus time relationship is generated. The stress-strain curve of FIG. 9 is finally obtained by eliminating time.

The specimen was unable to sustain strain in excess 0.47 at 36. In fact, the specimen could plastically deform to a maximum strain of 0.32 at 38, afterwards the stress rapidly decreased due to multiple cracking. A second specimen was loaded to a lower strain of 0.25 at line 40. Cracks parallel to the load direction were observed. No shear band was evidenced. It was unlikely that shear bands could be generated by increasing the amount of deformation as the specimen is likely to fail due to the facts. The third test was performed with a 0.45 strain limiter at line 42. The large bulging effect of this high deformation induced lateral contact between the specimen and the strain limiter. Therefore, the loading conditions were modified by having the specimen under lateral confinement at some given deformation. This deformation was identified by comparing the stress-strain responses of the specimen with and without the 0.45 strain limiter. FIG. 9 shows that the stress-strain response is similar up to a strain of 0.33 at 44, indicating that no lateral contact had occurred till that point. At larger strains, the stress of the specimen with the 0.45 limiter increases at 46, indicating that confinement had occurred.

After being carefully separated from the limiter, a macrophotograph of the specimen was taken. FIG. 10 shows the macrophotograph of the polished selection of the dynamically tested specimen. As FIG. 10 illustrates, intense 45° shear bands 48 and 50 appear in the alloy. Consequently, under moderate confined pressure, the W—Ni—Mn alloy of the present invention was able to promote shear banding at a strain of 0.45. These types of constrained conditions appear in ballistic penetration events. It should be noted that the specimen loaded under confinement did not present cracks parallel to the loading direction as observed in the specimen loaded to a strain 0.25.

Moreover, FIG. 11 also shows the internal section at 52 of the shear band crack after 45% compression. This led to lateral constraint of the specimen. The microstructure shown in FIG. 11 affords an internal view of the shear crack. By comparison with known conventional heavy alloys the shear band crack in the W—Ni—Mn alloy is much straighter. In fact, it more nearly resembles the classical straight, flat adiabatic shear band observed in steels. These characteristics favor adiabatic shear crack development process. Certain aspects of the crack profile, especially the rounded tips and crack segments, suggest interfacial melting that is also characteristic of an adiabatic shear.

It has been shown, that the W—Ni—Mn alloy of the present invention can be sintered to 96% of theoretical density by liquid phase sintering at temperatures in the range of 1200° to 1300° C. This sintering temperature is lower than the temperature used (1500° C.) to liquid phase sinter known tungsten heavy alloys, and is within the range of temperatures used by general part manufacturers. Additionally, the alloy has finer grains compared to conventional heavy alloys. The alloy in its present form has no tensile ductility. This can attributed to the retained porosity and the unreduced manganese oxide present in the alloy. In spite of the porosity, the material may be plastically deformed to a strain greater than 0.30 in quasi-static compression. Thus, the material is not inherently brittle, and with proper fine tuning of the processing conditions the alloy can be sintered to full density.

Porosity of the alloy may be essentially eliminated by subsequent hot isostatic pressing (HIP). This will result in further improved properties. Removal of manganese oxide may require more extensive use of clean powders, and inert gas handling of the powders.

When the material was subjected to large deformation (45% compression) at high strain rate of 5,000 $s^{-1}$, the bulging of the specimen induced lateral contact between the specimen and the strain limiter. The specimen exhibited two intense 45° shear bands. The nature of the bands suggest that it is an adiabatic shear band. Also, the finer grain size of the new alloy provides an easy path for the crack to propagate. Thus, the alloy of the present invention has tremendous potential as an improved kinetic energy penetrating material.

The tungsten heavy alloy of the present invention may be used as aircraft and helicopter balance weights which try to concentrate the maximum weight into the smaller space. The ability of this alloy to be sintered at the right temperatures, provides a great deal of impetus for using this alloy instead of the classic W—Ni—Fe-based alloys in applications where the materials is not subjected to any significant loads. Other applications could include radiation shields, balancing weights for instruments and sports equipment. Lowering of the sintering temperature to around 1200° C. provides the general powder metal manufacturers the ability to enter into the tungsten heavy alloy production without major changes in their furnaces.

Although the present invention and its advantages have been described in detail, it should be understood that various changes, substitutions and alterations can be made herein without departing from the spirit and scope of the invention as defined in the appended claims.

What is claimed is:

1. A process for producing a heavy alloy, said alloy having high density, high strength and high compressive strains, said process comprising the step of:

mixing a composition of elemental powders, said composition consisting essentially of W in the amount of at least 80% by weight and the remaining amount of Mn and Ni in an amount sufficient to lower the sintering temperature of said alloy to between 1100° and 1400° C.

2. The process of claim 1, further comprising the step of compacting said mixed composition into a predetermined shape, and sintering said predetermined shapes at a plurality of predetermined sintering temperatures.

3. The process of claim 2, further comprising the steps of sintering said shapes, sintering comprising the steps of:

(a) in a dry hydrogen atmosphere, (i) raising the temperature of said composition to approximately 800° C.;

(ii) holding said composition at 800° C. for a predetermined period of time;

(iii) raising said composition to a sintering temperature of between 1100° and 1400° C.; and (iv) holding said composition at said sintering temperature for approximately 40 minutes; and (b) replacing said dry hydrogen atmosphere with a dry argon atmosphere while holding said composition at said sintering temperature for a further 20 minutes.

4. The process of claim 2, wherein said shapes comprise 12 millimeter pellets.

5. The process of claim 2, wherein said shapes comprise elongated rods.

6. The process of claim 2, wherein said shapes comprise dogbone shapes.

7. The process of claim 1, further comprising the step of isostatically compressing said mixture into rods.

8. The process of claim 1, wherein said sintering temperature ranges between 1200° and 1300° C.

9. A method for sintering a composition of elemental powders for producing a tungsten heavy alloy, said tungsten heavy alloy having high density, high strength, and high compressive strains, said method comprising the steps of:

(a) mixing a composition of elemental powders, said composition consisting essentially of W in the amount of at least 80% by weight and the remaining amount of Mn and Ni in an amount sufficient to lower the sintering temperature of said alloy to between 1100° and 1400° C.;

(b) in a dry hydrogen atmosphere, (i) raising the temperature of said composition to approximately 800° C.;

(ii) holding said composition at 800° C. for a predetermined period of time;

(iii) raising said composition to a sintering temperature of between 1100° and 1400° C.; and (iv) holding said composition at said sintering temperature for approximately 40 minutes; and (c) replacing said dry hydrogen atmosphere with a dry argon atmosphere while holding said composition at said sintering temperature for a further 20 minutes.

10. The process of claim 9, wherein said predetermined time comprises approximately 60 minutes.

11. The process of claim 1, wherein said sintering temperature ranges substantially between 1100° and 1200° C.

12. The process of claim 9, wherein said sintering temperature ranges substantially between 1200° and 1300° C.

13. The process of claim 9, wherein said sintering temperature ranges substantially between 1100° and 1200° C.

14. The process of claim 9, wherein said amount of Mn is approximately 6% by weight and said amount of Ni is approximately 4% by weight.

15. The process of claim 1, wherein said amount of Mn is approximately 6% by weight and said amount of Ni is approximately 4% by weight.

16. A method for sintering a composition of elemental powders for producing a tungsten heavy alloy, said tungsten heavy alloy having high density, high strength, and high compressive strains, said method comprising the steps of:

(a) mixing a composition of elemental powders consisting essentially of W in the amount of at least 90% by weight, Mn in approximately 6% by weight, and Ni in approximately 4% by weight;

(b) in a dry hydrogen atmosphere, (i) raising the temperature of said composition to approximately 800° C.;

(ii) holding said composition at 800° C. for 60 minutes; and (iii) raising said composition to a sintering temperature of between 1200° and 1300° C.; and (iv) holding said composition at said sintering temperature for approximately 40 minutes; and (c) replacing said dry hydrogen atmosphere with a dry argon atmosphere while holding said composition at said sintering temperature for a further 20 minutes.

17. The process of claim 16, further comprising the step of isostatically compressing said mixture into rods.

18. The process of claim 16, wherein the sintering temperature of said alloy is substantially between 1100° and 1200° C.

* * * * *